US006085719A

United States Patent [19]

Heinz et al.

[11] Patent Number: 6,085,719

[45] Date of Patent: Jul. 11, 2000

[54] FUEL INJECTION SYSTEM FOR INTERNAL COMBUSTION ENGINES

[75] Inventors: Rudolf Heinz, Renningen; Dieter Kienzler, Leonberg; Roger Potschin, Brackenheim; Klaus-Peter Schmoll, Lehrensteinsfeld; Friedrich Boecking, Stuttgart, all of Germany

[73] Assignee: Robert Bosch GmbH, Stuttgart, Germany

[21] Appl. No.: 09/289,617

[22] Filed: Apr. 12, 1999

[30] Foreign Application Priority Data

Apr. 11, 1998 [DE] Germany ..... 198 16 316

[51] Int. Cl.[7] ..... F02B 3/00; F02M 41/00

[52] U.S. Cl. ..... 123/300; 123/467

[58] Field of Search ..... 123/299, 300, 123/467, 506, 446, 447

[56] References Cited

U.S. PATENT DOCUMENTS

| | | | |
|---|---|---|---|
| 5,477,834 | 12/1995 | Yoshizu | 123/299 |
| 5,622,152 | 4/1997 | Ishida | 123/467 |
| 5,664,545 | 9/1997 | Kato | 123/467 |
| 5,671,715 | 9/1997 | Tsuzuki | 123/467 |
| 5,771,865 | 6/1998 | Ishida | 123/300 |
| 5,862,793 | 1/1999 | Jay | 123/299 |
| 5,890,471 | 4/1999 | Nishimura | 123/467 |
| 5,979,410 | 11/1999 | Grieshaber | 123/300 |

FOREIGN PATENT DOCUMENTS 196 24 001 A1 12/1997 Germany .

*Primary Examiner*—Carl S. Miller

*Attorney, Agent, or Firm*—Ronald E. Greigg; Edwin E. Greigg

[57] ABSTRACT

A fuel injection system for internal combustion engines is proposed which supplies fuel injection valves with fuel from a high-pressure fuel source, under the control of a control unit. The fuel injection valve has an injection valve member, whose opening or closing position is determined by a pressure that acts upon this injection valve member and that is set in a control chamber. To that end, to perform an injection, the pressure in the control chamber must be relieved; which is achieved with a control valve that opens two different outflow cross sections of an outflow conduit of the control chamber in succession. This makes it possible to accomplish an adapted opening of the fuel injection valve member for a preinjection and for a main injection.

22 Claims, 5 Drawing Sheets

FUEL INJECTION SYSTEM FOR INTERNAL COMBUSTION ENGINES

BACKGROUND OF THE INVENTION

The invention is based on a fuel injection system for internal combustion engines. In one such fuel injection system, known from German Patent Disclosure DE 196 24 001 A1, the valve chamber in a first version communicates with the control chamber without any reduction in cross section. The control valve, upon actuation by the piezoelectric actuator, either completely opens the outflow cross section toward the outflow conduit or closes it. In a further version, the valve chamber communicates with the control chamber via a connecting conduit, and this connecting conduit is coaxial with the valve seat on the side toward the outflow conduit. By actuation of the control valve member by the piezoelectric actuator, either the outflow cross section from the valve chamber to the outflow conduit is completely opened or closed, or to attain a preinjection the control valve member is moved from the valve seat toward the outflow conduit so that the connecting conduit will enter the valve chamber; as a consequence of this motion, the control chamber is briefly opened toward the outflow conduit via the valve chamber. For an ensuing main injection, the control valve member is moved to a middle position, in which both the cross section toward the outflow conduit and the cross section of the connecting conduit into the valve chamber are opened completely. This embodiment has the disadvantage that to relieve the pressure in the control chamber, only a single geometrically defined outflow cross section toward the outflow conduit is available. The quantity of the preinjection, in the second version described, is such that the adjusting speed of the control valve member by the piezoelectric actuator and the geometrically defined travel of the control valve member are defined variables for the degree of relief of the pressure in the control chamber. In particular, the maximum relief cross section is the same size for both the relief for the preinjection and the relief for the main injection, which is disadvantageous from the standpoint of fine adaptation of the opening speed of the injection valve in various operating states.

OBJECT AND SUMMARY OF THE INVENTION

The fuel injection system of the invention has the advantage that two outflow cross sections can be opened sequentially, that is, in succession, by the control valve of the invention. A gradation of the outflow cross section as a function of the stroke can thus be attained. Particularly for minimal reliefs of the control pressure in the control chamber, a first, smaller outflow cross section can come into effect, with which the preinjection can be set with greater accuracy. For the main injection, a large outflow cross section is accordingly available, which permits a rapid motion of the injection valve member. Advantageously, a sleevelike drag valve member is provided, which controls a second outflow cross section of the outflow conduit once the control valve member has executed a first stroke that relieves the control chamber. The pressure reduction in the valve chamber or control chamber that then occurs before the second outflow cross section is opened by the drag valve member and facilitates a rapid opening of the second outflow cross section following the opening of the first outflow cross section in the first motion of the drag valve member. The attainable result is in particular a rapid opening of the injection valve member at the onset of the main injection.

In a further embodiment, advantageous types of outflow cross section formation are proposed. To open the second outflow cross section by the drag valve member, this member can advantageously, be lifted from its main valve seat by a driver on the control valve member. In an alternative embodiment, the drag valve member can advantageously also be moved in the opening position by a compression spring, given a corresponding lowering of the pressure in the valve chamber, because after the pressure is reduced it can follow the control valve member. In one terminal position of the control valve member, the outflow cross section is determined by the cross section at the main valve seat. The embodiment set forth offers an accurate guidance of the drag valve member on the valve tappet. The quality of guidance of the valve tappet can be further increased by providing a sleeve on the valve tappet, whose outer diameter is greater than the diameter of the inner boundary face of the drag valve member. Advantageously, this sleeve is press-fitted onto the tappet, after the drag valve member has been threaded onto the tappet, and can then be installed as a unit.

The invention will be better understood and further objects and advantages thereof will become more apparent from the ensuing detailed description of preferred embodiments taken in conjunction with the drawings.

DESCRIPTION OF THE PREFERRED EMBODIMENTS

A fuel injection system, with which at high injection pressures a wide variation in fuel injection with respect to injection quantity and instant of injection is possible at little expense, is realized by a so-called common rail system. This furnishes a different type of high-pressure fuel source than is provided by the usual high-pressure fuel injection pumps. However, the invention can also in principle be employed with conventional fuel injection pumps. Still, its use in a common rail injection system is especially advantageous.

Figure 1:
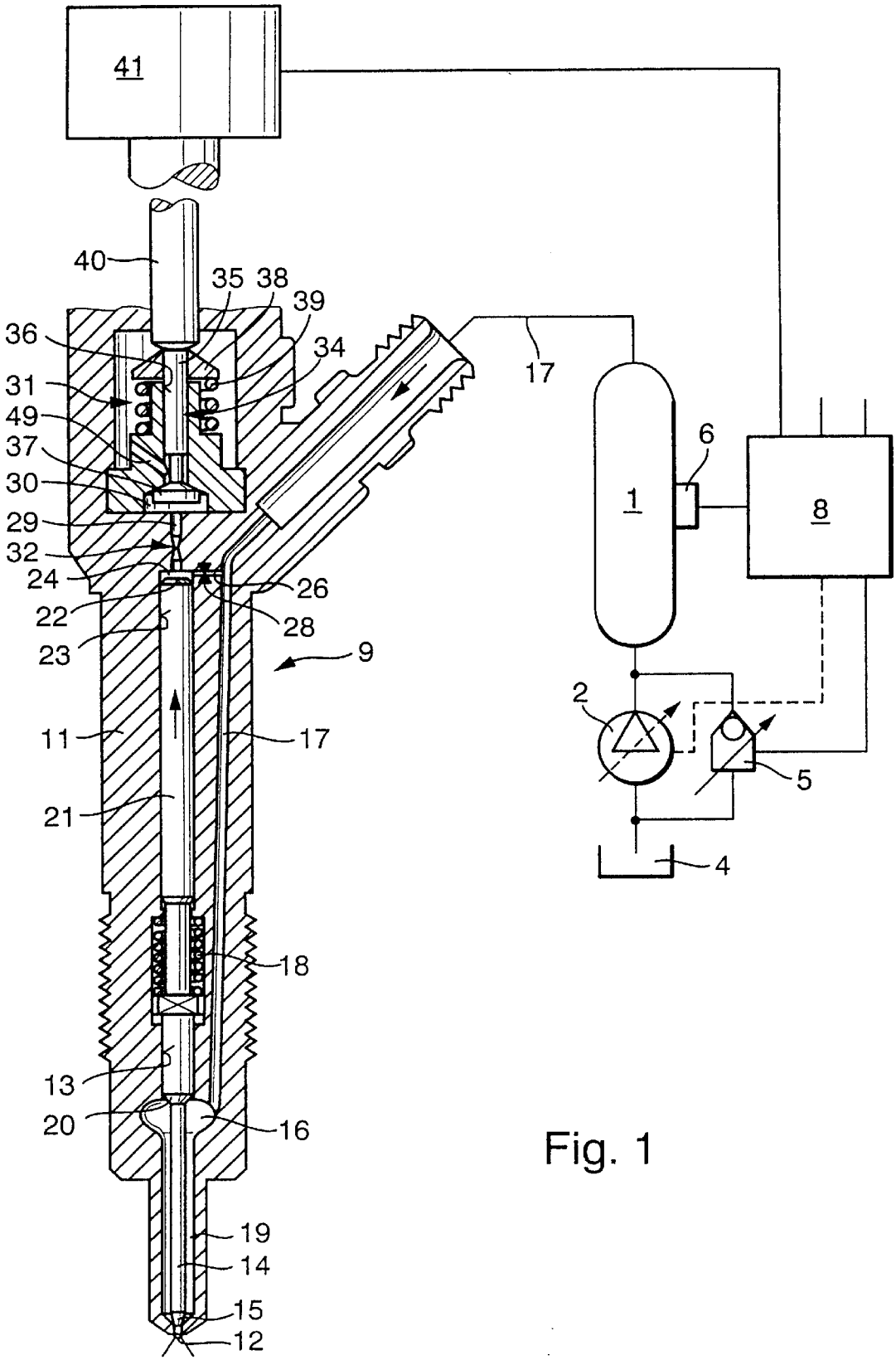
FIG. 1 schematically shows a fuel injection system with a fuel supply from a high-pressure fuel reservoir and a fuel injection vale of a known design.

In the common rail injection system shown in FIG. 1, a high-pressure fuel reservoir 1 is provided as a high-pressure fuel source, which is supplied with fuel from a fuel tank 4 by a high-pressure fuel feed pump 2. The pressure in the high-pressure fuel reservoir 1 is detected by a pressure sensor 6 and delivered to an electric control unit 8, which via a pressure control valve 5 controls the pressure in the high-pressure fuel reservoir. The control unit also controls the opening and closing of high-pressure fuel injection valves 9, which are supplied from the high-pressure fuel reservoir with fuel for injection.

In a known feature, the fuel injection valve 9 has a valve housing 11, which on one end, intended for installation on the engine, has injection openings 12, whose exit from the interior of the fuel injection valve is controlled by an injection valve member 14. In the example being described, this member is embodied as an elongated valve needle, which on one end has a conical sealing face 15 that cooperates with an inner valve seat on the valve housing, from which the injection openings 12 lead away. The valve needle is guided, on its upper end remote from the sealing face 15, in a longitudinal bore 13 and is urged, on the end remote from the sealing face 15 and emerging from the longitudinal bore 13, in the closing direction by a compression spring 18. Between the guidance in the longitudinal bore 13 and the valve seat, the valve needle 14 is surrounded by an annular chamber 19, which discharges into a pressure chamber 16 that in turn, via a pressure line 17, communicates constantly with the high-pressure fuel reservoir 1. In the region of this pressure chamber, the valve needle 14 has a pressure shoulder 20, by way of which it is acted upon by the pressure in the pressure chamber 16, counter to the force of the spring 18, in the direction of lifting up of the sealing face 15 from the valve seat.

The valve needle is also acted upon by a tappet 21, whose face end 22 remote from the valve needle 14 defines a control chamber 24 in a tappet guide bore 23. Via an inflow conduit 26, in which an inlet throttle 28 is provided, the control chamber communicates constantly with the pressure line 17, or with the high-pressure fuel reservoir 1. The inflow conduit discharges laterally and unclosably into the control chamber 24. Coaxially with the tappet 21, a connecting conduit 29 leads away from the control chamber 24 and discharges into a valve chamber 30 of a control valve 31. In the connecting conduit, which at the same time is also an outflow conduit, a diameter limitation is provided, preferably in the form of an outflow throttle 32. The structure of the control valve 31 is shown in greater detail in the various exemplary embodiments shown in FIGS. 2–7. A common feature of these exemplary embodiments is that the control valve 31 has a control valve member 34, comprising a valve tappet 35 that is guided in a tappet bore 36, and a valve head 37 on the end of the control valve member 34 that protrudes into the valve chamber 30. On the end of the valve tappet 35 opposite the valve head, a spring plate 38 is provided, on which a compression spring 39 is braced which seeks to move the control valve member in the closing position. In the opposite direction, the control valve member 34 is acted upon by a piston 40, which is part of a piezoelectric actuator 41, and which, upon excitation of the piezoelectric element, can put the control valve member in various opening positions, depending on the degree of excitation. The piston may be joined directly to the piezoelectric element of the piezoelectric actuator, or may be moved by it by means of a hydraulic or mechanical stepup.

For the sake of more precise description of the embodiment according to the invention of the control valve 31, this valve will be described in further detail in conjunction with FIG. 2. Once again, this shows the end of the tappet 21 that actuates the valve needle 14. In the tappet guide bore 23, the tappet 21, with its face end 22 acting as a movable wall, defines the control chamber 24. An upper limit to the adjustment of the tappet 21 is provided by a stop 42, which leaves open an outer annular chamber 43 into which the inlet 26 discharges. The connecting conduit 29 leads axially away in the region of the stop 42; the connecting conduit includes the outflow throttle 32 and discharges into the valve chamber 30. This valve chamber has a circular-cylindrical circumferential wall 45, which via a conical valve seat 46 changes over into an annular chamber 48 surrounding the valve tappet 35. From there, an outflow conduit 49 leads away to a fuel return or a relief chamber.

The valve head 37 disposed on the end of the valve tappet 35 has a conical valve head sealing face 51, remote from the entrance of the connecting conduit 29 into the valve chamber 30; this face 51 cooperates with a pilot valve seat 52, forming a pilot valve 58. This pilot valve seat 52 is located at the transition to an inner through bore 53 of a sleevelike drag valve member 54, which surrounds the valve tappet with clearance. The inner circumferential wall of the inner through bore 53 thus, together with the jacket face 55 of the valve tappet 35, forms a flow cross section 56. To define the position of the sleevelike drag member 54, the drag member is guided via spacing ribs 57 on the valve tappet 35. These ribs leave the adequately dimensioned flow cross section 56 available.

On the end axially opposite the pilot valve seat 52, the sleevelike drag member 54 has a valve member sealing face 59, which is also embodied conically, with a smaller cone tip angle than the cone tip angle of the conical valve seat 46, and which cooperates with the valve seat 46. The conical valve seat 46 acts as a main valve seat of a main valve 61, which defines a substantially larger flow cross section from the valve chamber 30 to the annular chamber 48 than the flow cross section which is defined between the valve head 37 and the pilot valve seat 52 of the pilot valve 58. Also, for better guidance of the sleevelike drag valve member, longitudinal ribs 60 with grooves between them are also provided between the drag valve member and the circumferential wall 45 of the valve chamber 30; these ribs leave an adequately large flow cross section 56 to the main valve 61 available.

Figure 2:
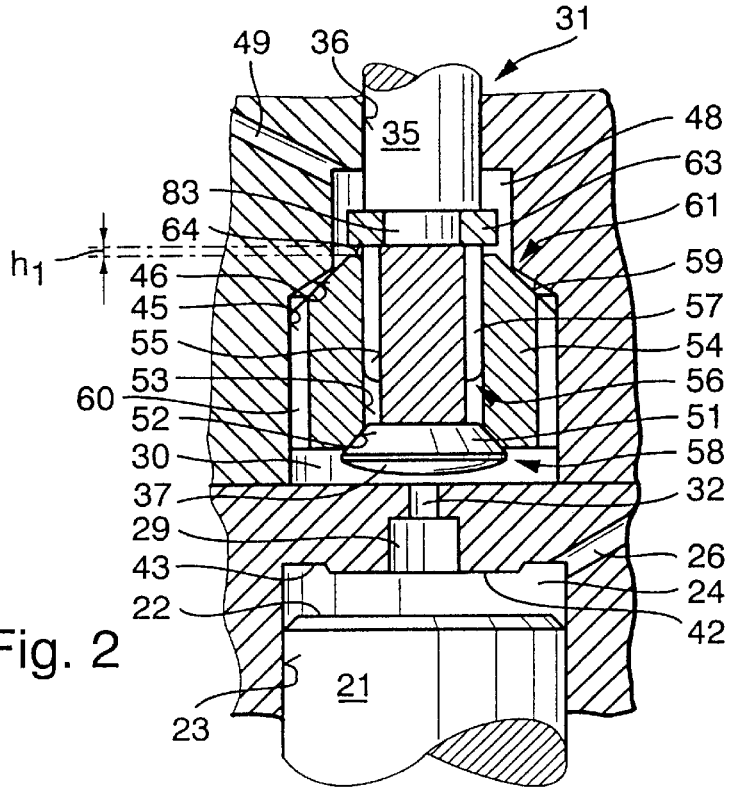
FIG. 2 shows a first exemplary embodiment of the invention with a control valve member, on which a drag valve member is disposed that is moved away from its valve seat by a driver on the valve tappet.

In FIG. 2, the control valve 31 is shown in the closing position, in which the valve head 37, with its sealing face 51, attains contact with the pilot valve seat 52 and via this seat has made the sleevelike drag valve member 54, with its drag valve sealing face 59, come into contact with the main valve seat 46, so that communication between the valve chamber 30 and the annular chamber 48, or the outflow conduit 49, is prevented.

In this closing position of the control valve member, the control chamber 24 is kept at the pressure of the high-pressure fuel reservoir 1 by the constant inflow of high-pressure quantities of fuel, which has the effect that the tappet 21 keeps the injection valve member 14 in its closing position on the valve seat. This is because the surface area of the movable wall 22 is substantially greater than the surface area of the pressure shoulder 20 of the injection valve member 14, which shoulder is acted upon by the same pressure. This high pressure in the control chamber 24 also urges the valve head 37 and the sleevelike drag member 54 in their respective closing directions.

To initiate an injection, the piezoelectric actuator is triggered, which thereby adjusts the control valve member by the distance of an opening stroke. First, the pilot valve 58 is opened when the valve head 37 lifts up from the pilot valve seat 52. A fractional quantity of fuel can flow out of the valve chamber or control chamber to the outflow conduit 49 via the flow cross section 56. Nevertheless, the pressure in the valve chamber 30 remains high enough that the drag valve member remains with its valve member sealing face in the closing position on the main valve seat 46. Only when the stroke of the control valve member is so great that a driver 63, which is secured to the valve tappet 35 and for instance takes the form of a U-shaped clamping element, comes into contact with the end face 64 of the sleevelike drag valve member is this member, upon the further motion of the valve tappet 35, lifted from the main valve seat 46, so that now a larger outflow cross section is uncovered for the relief of the valve chamber 30 or of the control chamber 24. With the decrease in excitation of the piezoelectric actuator, the valve tappet 35, under the influence of the spring 39, drops back to the outset closing position shown, along with the dragged sleevelike drag valve member 54.

The great advantage of a piezoelectric drive is the fact that a control valve member actuated by it can be moved to defined positions in accordance with the excitation of the actuator. Thus injections can be subdivided both simply and exactly into a preinjection and a main injection. A preinjection, given the above-described construction of the fuel injection valve, requires only a slight relief of the control chamber 24, such that the injection valve member brings about only a brief opening of the injection openings 12. For a main injection, conversely, for execution of a long, fast stroke by the injection valve member 14, the control chamber 24 must be relieved quickly and effectively. The faster the injection valve can open or close, the more accurately can the injection phase be determined. Because the inlet 26 contains the inlet throttle 28, and the latter is smaller than the cross section on the outflow side of the control chamber 24, and in particular the cross section of the outflow throttle 32, the effective relief of the control chamber is achievable. The final control of the cross section toward the outflow conduit 49 is taken over by the control valve. This control valve must first work against the high pressure in the control chamber 24 or valve chamber 30. However, since the outflow cross section at the pilot valve 58 is small in comparison with the main valve 61, relatively little work is required to open the pilot valve 58. The opening of the pilot valve already substantially reduces the pressure in the valve chamber 30, so that whenever a relatively large wall, acted upon by the pressure in the valve chamber 30, is to be adjusted counter to this pressure, the force to be exerted is already less. With less force thus being necessary than in a one-step opening operation, the cross section of the main valve is opened quickly, which leads to a correspondingly rapid relief of the valve chamber and the control chamber. The control of the control valve can be done such that with the opening of the pilot valve 58, the pressure in the control chamber 24 is already reduced enough to enable a short opening stroke of the injection valve member 14. After that, the control valve member 34 and via the drag valve member 54 can open the larger outflow cross section, so that with the then ensuing rapid relief it can initiate the opening of the injection valve member 14 for the main injection. The termination of the main injection is controlled by the closure of the control valve, and thus the injection quantity is so-controlled as well.

In an alternative embodiment of the triggering of the control valve of the invention, the pressure after the opening of the pilot valve can be relieved only so far that the injection valve member 14 still remains closed, yet an even slighter further relief does cause it to open. By an ensuing further adjustment of the valve tappet 35, a brief further relief of the pressure in the control chamber 24 or valve chamber 30 can be effected in order to create a preinjection, by increasing the degree of opening of the pilot valve and/or by opening the drag valve member in delayed fashion; the preinjection can then be terminated by shortening the valve tappet stroke. This is then followed by a longer valve tappet stroke, in which once again, via the drag valve member 54, a full relief of the control chamber 24 is brought about, so that the main injection can take place.

With the aid of the stroke h1 of the valve tappet 35, which is necessary so that the driver 63 will contact the face end 64 of the drag valve member 54, the opening stroke of the pilot valve can be defined. The face end 64 is designed such that even when the annular driver 63 is in contact, the sufficient flow cross section 56 from the valve chamber 30 to the annular chamber 48 is available. For instance, the face end may be embodied in crownlike fashion, with radial flow cross sections. The definition of the outflow cross section by the outflow throttle 32, which in the example being described is disposed in the connecting conduit 29, can also be done at some other point, for instance in the outflow conduit 49 or by dimensioning a maximum flow cross section 56 in between.

Figure 8A:
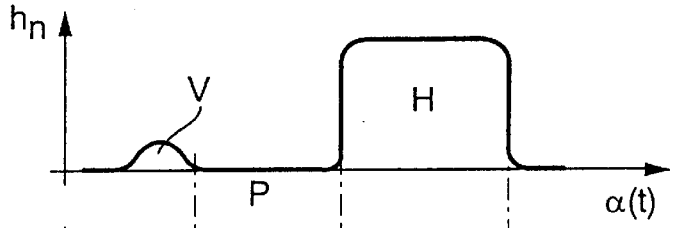
FIG. 8*a* represents the stroke of the injection valve member plotted over a rotational angle of the crankshaft.
Figure 8B:
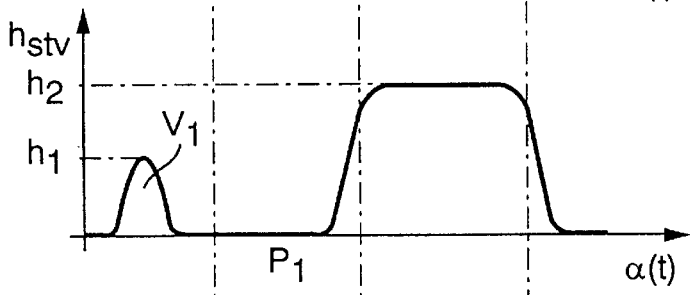
FIG. 8*b* represents the pressure P1 in relationship with the stroke of the injection valve.
Figure 8C:
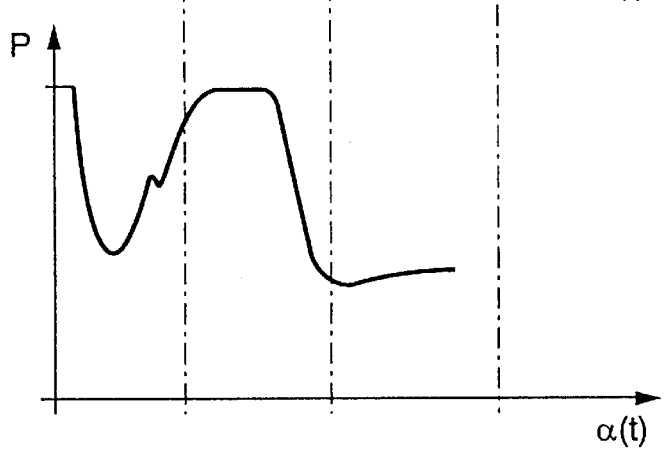
FIG. 8*c* illustrates a coarse of the pressure in the control chamber as the control valve opens.

The control sequences of this control valve can be seen in FIGS. 8*a*–8*c*. In FIG. 8*a*, the stroke of the injection valve member 14 is plotted over the rotational angle of the crankshaft or over time. One can see the shorter pilot stroke V of the injection valve needle 14, for performing the preinjection; the intervening pause P, in which the control valve is closed entirely, or enough that a pressure that puts the injection valve member back in the closing position is established in the control chamber 24; and the ensuing stroke H, whose duration defines the main injection. This process is tripped by the strokes of the control valve member, which are shown in the sequence below. One can see the stroke V1, by which, when the maximally open position at the stroke H1 of the tappet 35 is reached, or in other words before the drag valve member is lifted from the main valve seat, for instance, the control chamber 24 is relieved in such a way that the stroke of the injection valve member 14 for the stroke V can begin. Via the stroke V1, the relief for the preinjection is maintained. In the actuation pause P1 of the control valve member, that is, with the piezoelectric element not excited, the injection valve member 14 stays closed. At the end of P1, the reactuation of the control valve member 34 by the piezoelectric element begins, up to a stroke H2, in which the entire diversion cross section is opened after the opening of the main valve 61 by the drag valve member 54, and the control chamber 24 is maximally relieved. The injection valve member already opens in the range between H1 and H2, and it remains in the open position over the length of time that the control valve is opened, until in the closing motion of the control valve member the pressure in the control chamber 24 again drops below the pressure that is capable of keeping the injection valve member open.

The graph 8*c* below shows the course of pressure in the control chamber 24, with attendant pressure incursions whenever the control valve member h1 has opened as shown in graph 8*b*.

Figure 3:
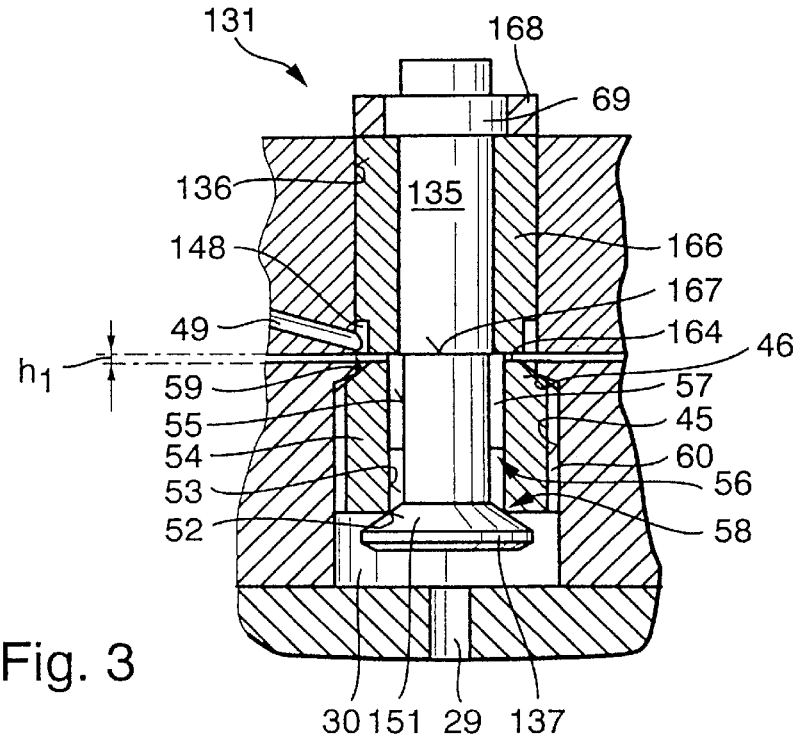
FIG. 3 a modification of the exemplary embodiment of FIG. 2, with control valve member that has improved guidance.

A modification of the control valve of FIG. 2 is shown in FIG. 3. To the extent that this embodiment agrees with FIG. 2, the same reference numerals are employed. In this respect, see the corresponding description of FIG. 2. In a departure from the version of FIG. 2, in FIG. 3 a sleeve 166 is disposed on the tappet 135 in the region in which, in FIG. 2, the valve tappet 135 is guided in the tappet bore 36. In FIG. 3, this sleeve is fixed to the tappet axially between a stop 167 and a lock washer 168. The stop is formed by a shoulder of the tappet that is provided at the end of the spacer ribs 57 that protrude from the sleevelike drag member 54. The lock washer may for instance be in the form of a snap ring in an annular groove 69 of the tappet, on its end that protrudes from the tappet bore 136. Alternatively, however, the sleeve can also be press-fitted onto the tappet 135. The stop 167 also defines the stroke h1 beyond which the tappet, which moves together with the sleeve 166, attains contact with the sleevelike drag member 54. The sleeve 166, on its lower end pointing toward the drag valve member 54, also has a diameter reduction, with which, replacing the annular chamber 48 of FIG. 2, an annular chamber 148 is formed here that communicates constantly with the outflow conduit 49. As in the previous exemplary embodiment of FIG. 2, the drag member 54 is designed on its end face such that an overflow cross section is left open that is on the order of magnitude of the flow cross section 56 in terms of size.

With this embodiment, the advantage is attained that the guide area inside the tappet bore 136 is larger, and the control valve member is thus guided more exactly. Since for assembly the tappet 135 has to be passed through the inner through bore 53, there would actually be a limit to enlarging the guiding diameter of the tappet in the region of the tappet bore of FIG. 2. By adding the sleeve 166, the guide area can nevertheless be increased; the sleeve is mounted later, after the drag valve member 54 has been threaded onto the valve tappet. The outer diameter of the sleeve is larger than the diameter of the inner through bore 53 of the drag valve member and is smaller than the diameter of the valve chamber 30.

Figure 4:
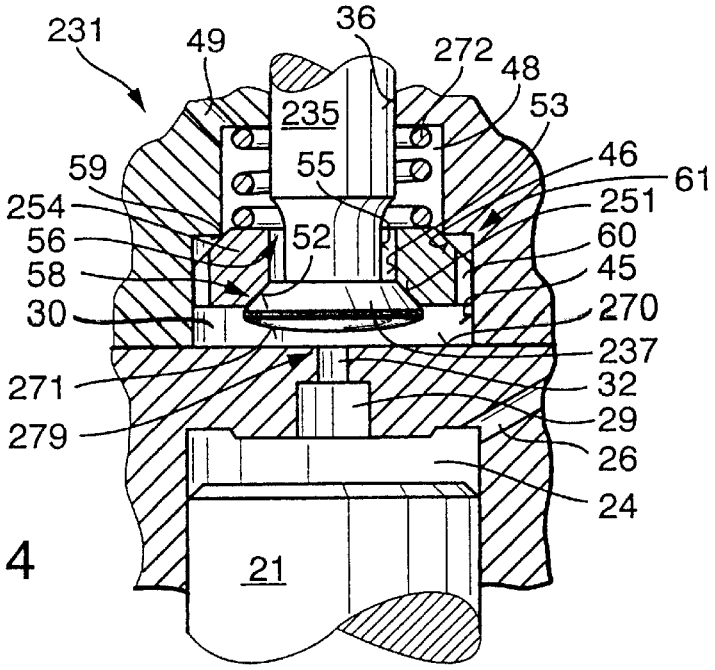
FIG. 4 shows a third exemplary embodiment of the invention in a refinement of the exemplary embodiment of FIG. 2, in which instead of a driver for driving the drag valve member a compression spring is provided.
Figure 5:
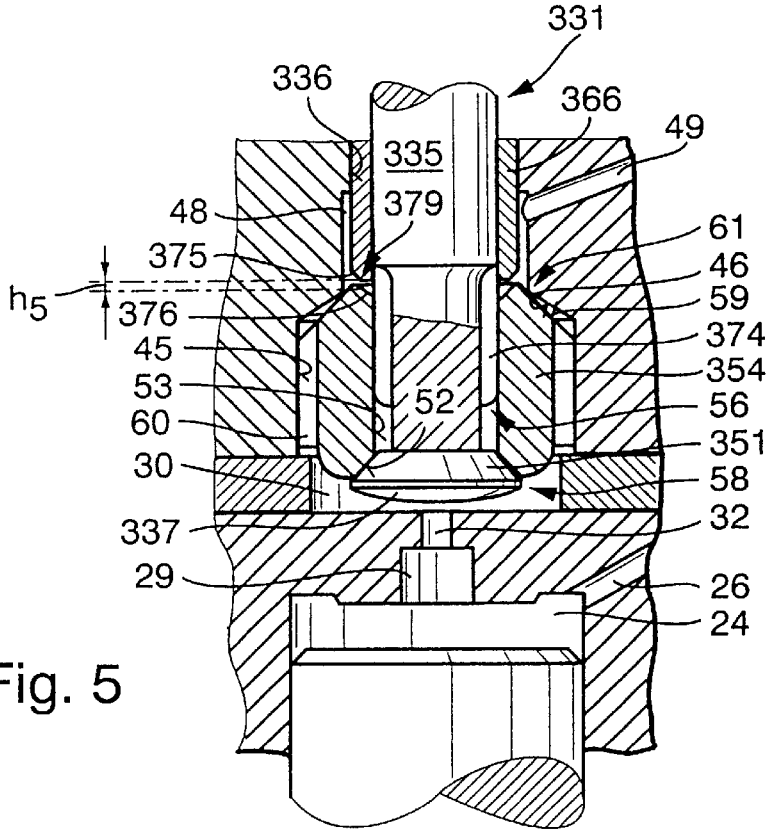
FIG. 5 shows a fourth exemplary embodiment of the invention, in which a third valve seat is provided on the drag valve member.

A further variant of a control valve, in a modification of the exemplary embodiment of FIG. 2, is shown in FIG. 4. Once again, two different outflow cross sections of the outflow conduit are opened one after the other. As in FIG. 2, once again the control chamber 24 defined by the tappet 21 of the injection valve member 14 is provided, which communicates with the valve chamber 30 via the connecting conduit 29 that contains the throttle 32. The tappet 235 protrudes into this valve chamber with its valve head 237 and the valve head sealing face 251, which in the closing state of the control valve contacts the pilot valve seat 52 of the sleevelike drag valve member 54, forming the pilot valve 58. Via the valve head 237, this pilot valve is additionally kept with its valve member sealing face 59 in contact with the main valve seat 46 of the main valve 61. The annular chamber 48 is again located on the far side of this valve seat 46; it is pierced by the tappet 235 and communicates constantly with the outflow conduit 49. As in the exemplary embodiments of FIGS. 2 and 3, the sleevelike drag valve member 54 is guided with its outer circumference along the circumferential wall 45 of the valve chamber 30, via longitudinal ribs 60 formed by grooves between them. These longitudinal ribs leave the flow cross section open toward the main valve 61. The inner through bore 53 of the drag valve member 54 is spaced apart from the valve tappet 35, so that beginning at the pilot valve, a corresponding flow cross section 56 exists relative to the annular chamber 48 or outflow conduit 49.

The connecting conduit 29 is coaxially opposite the valve head 237 and discharges there in an axial boundary wall 270 of the valve chamber 30. Opposite the discharge point of the connecting conduit 29, the valve head 237 is provided on its face end with a sealing face 271, which can either be tapered or conical. The region of the outlet of the connecting conduit 29 at the axial boundary wall 270 is correspondingly formed as a valve seat, so that the connecting conduit can be closed by the sealing face 271. Thus the axial boundary wall is embodied as a valve seat for a third valve 279, whose valve member is the valve head 237.

In this valve, the actuation of the valve tappet 235 is effected such that to accomplish a preinjection, the valve head 237 is moved all at once away from its contact with the pilot valve seat 52 until its sealing face 271 contacts the valve seat 270 of the third valve 279, or the axial boundary wall 270. Over the course of travel of the valve head, a brief relief of the valve chamber 30 and control chamber 24 is accomplished, which given suitable dimensioning is sufficient to bring about an opening of the injection valve member 14 for the execution of a preinjection. If the valve head 237 rests tightly with its sealing face 271 against the axial boundary wall 270, or in other words if the connecting conduit 29 is completely closed, then the pressure in the valve chamber can decrease further, during which the pressure in the control chamber 24 is built up again via the inlet 26, the consequence of which is closure of the injection valve needle 14. The pressure relief in the valve chamber 30 in turn means that the restoring forces of a compression spring 272, which is disposed in the annular chamber 48 and is braced between the housing and the face end toward the annular chamber of the drag valve member 54, predominate and cause the drag valve member 54 to track the adjustment of the valve head 437 until it again rests tightly on the valve head sealing face 251. If then afterward, by suitable control of the piezoelectric actuator, the valve head is moved into an intermediate position between the valve seats 270 and 46, the control chamber 24 can be relieved very rapidly to the full possible extent via the valve chamber 30 and the large opening cross section of the main valve 61, so that to execute a main injection here, a maximal, rapid adjustment of the injection valve member in the opening direction can be accomplished. The decoupling of the control chamber 24 from the pressure source 1 via the inlet throttle 28 here permits relief to virtually complete relief pressure, which is favored by the large outflow cross section at the outer circumference of the drag valve member. To terminate the main injection, the valve head is moved back again together with the drag valve member 54, thereby tightly closing the pilot valve 58 and the main valve 61. The great advantage of this embodiment is that to execute the preinjection, only a single motion of the control valve member in one direction is needed, and to execute the main injection in turn, only a reverse motion, in the form of a partial stroke in the direction of the outset position, and an ensuing final restoring motion are needed.

While in the exemplary embodiments of FIGS. 2 and 3 only two valves were made in conjunction with the control valve member and the drag valve member, in the exemplary embodiment of FIG. 4 described above a total of three valves were realized, that is, the pilot valve 58 with the pilot valve seat 52, the main valve 61 with the main valve seat 46, and the third valve 279 with the valve seat 270. In an alternative embodiment of FIG. 5, once again three valves are realized. However, this version is based on the embodiment of FIG. 3. As in FIG. 3, once again the valve chamber 30 is provided, into which the connecting conduit 29, arriving from the control chamber 24, discharges coaxially with the valve tappet 35.

Once again, the valve head 337 is provided on the end of the tappet 335 protruding into the valve chamber 30; it has the valve head sealing face 351, which cooperates with the pilot valve seat 52 on the drag valve member 354, forming the pilot valve 58. This valve again, on its end remote from the valve head 337, has the valve member sealing face 59, disposed with a tapered inclination or conically on the outside of its circumferential wall, and this sealing face cooperates with the main valve seat 46, forming the main valve 61 at the transition between the valve chamber 30 and the annular chamber 48. The drag valve member is guided on its outer circumference by longitudinal ribs 60 along the circumferential wall of the valve chamber. A sleeve 366 is again press-fitted onto the valve tappet 335 and keeps an enlarged outer circumference ready, by way of which the valve tappet is guided in the tappet bore 336. This sleeve 366 protrudes into the annular chamber 48 that communicates with the outflow conduit 49, and there protrudes past an annular groove 374 of the tappet 335 that is axially defined by the valve head sealing face of the valve head 337 and maintains the radial spacing from the inner through bore 53 of the drag member 54 and thus forms the flow cross section 56. In its region overlapping the annular groove 374, the sleeve 366 here has a tapered sealing face 375 on its face end, which given suitable motion of the valve tappet 335 can be made to contact a tapered valve seat 376 on the face end of the drag valve member 354. Thus together with the tapered sealing face 375, this valve seat 376 forms a third valve 379. The tapered valve seat 376 is inclined toward the interior of the inner through bore 53 of the drag valve member 354, or in other words is inclined conversely to the inclination of the valve member sealing face 59 of the main valve 61.

In the closing position, shown, of the control valve, the valve head is made to contact the pilot valve seat 52 with its valve head sealing face, and the drag valve member 354, with its valve member sealing face 59, is also made to contact the main valve seat 46. This prevents the communication between the valve chamber 30 and the outflow conduit 49, and the control chamber 24 can be brought to the high pressure specified by the pressure source, bringing about the closure of the injection valve member 14. In an ensuing actuation of the control valve for executing a preinjection, the tappet 335 with the sleeve 366 is moved far enough that the tapered sealing face 375 of the sleeve 366 attains tight contact with the tapered valve seat 376 of the drag valve member 354. Via this stroke h5, a brief relief of the valve chamber 30 and control chamber 24 is effected, which suffices to move the injection valve member 14 into a preinjection position. With the closure of the third valve 275 by contact of the sealing face 375 with the tapered valve seat 376 after the stroke h5 has been traversed, the preinjection is terminated by a pressure buildup in the control chamber 24. For the main injection, the control valve member is then moved onward. As a result, the drag valve member 354 is lifted from the main valve seat 46, so that a full, maximal relief of the control chamber 24 occurs. A substantially larger cross section is available for this relief than was available for executing the preinjection, by opening of the pilot valve until the closure of the third valve. The advantage in this embodiment is that by means of a graduated supply of current to the piezoelectric actuator, the piezoelectric actuator need be switched in only one direction for both the preinjection and the main injection. This means fast switching times; in particular, by switching through from one valve seat 52 to the other valve seat 376, a very brief relief and thus a very small preinjection quantity can be attained. To terminate the injection, the tappet is returned to the outset position shown. For each injection event, a separate relief cross section is available, which can be adapted to given requirements.

Figure 6:
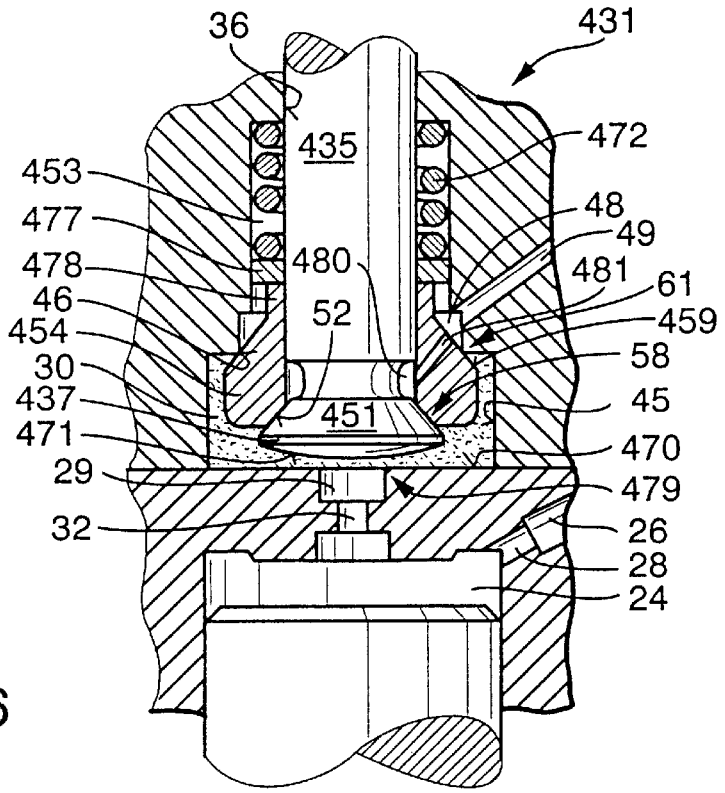
FIG. 6 shows a fifth exemplary embodiment, with a control valve member that controls both the outflow cross section from the valve chamber to the outflow conduit and the connecting conduit between the valve chamber and the control chamber.

A fifth exemplary embodiment of the invention is shown in FIG. 6, which represents a further development of the exemplary embodiment of FIG. 4. As in the exemplary embodiment of FIG. 4, three valves are realized by the cooperation of the valve head 437 and the drag valve member 454. Again as in FIG. 4, the connecting conduit 29 discharges into the valve chamber 30 coaxially with the valve tappet 435. Also as in the exemplary embodiment of FIG. 4, the axially oriented wall 470 of the valve chamber 30 at the entrance of the connecting conduit 29 is embodied as a valve seat of the third valve 479, against which the face end 471, embodied as a sealing face, of the valve head 437 can be brought into contact. The valve head 437 has a valve head sealing face 51, which cooperates with the pilot valve seat 52 at the transition from the face end of the drag valve member 454 to its inner through bore 53, forming the pilot valve 58. On the opposite end, the drag valve member 454 has a tapered valve member sealing face 459, which cooperates with the main valve seat 46 at the transition from the valve chamber 30 to the annular chamber 48, forming the main valve 61, also as in the exemplary embodiment of FIG. 4, the drag valve member 454 is urged in the direction of opening of the main valve 61 by a compression spring 472. Via a thrust washer 477, the spring 472 is supported on a stublike extension 478 of the drag valve member 54. In the region of this stublike extension 478, the drag valve member 454 is guided tightly on the outer jacket 455 of the valve tappet 435, so that an annular recess 480 is enclosed between the valve head 437 and the drag valve member 454; this recess is in constant communication with the annular chamber 48 via a throttle bore 481 extending through the drag valve member.

In this embodiment, three throttles are thus achieved: first, the inlet throttle 28 in the inlet 26 to the control chamber 24; second, the outflow throttle 32 in the connecting conduit 29; and third, the aforementioned throttle bore 81.

As in the exemplary embodiment of FIG. 4, to attain a preinjection the control valve member is actuated such that the valve head 437 is lifted from the pilot valve seat 52 and moved through until its sealing face 471 contacts the valve seat 470 of the third valve 479. Over the duration of this motion, a brief relief of the control chamber 24 occurs, which is determined by the cross section of the throttle bore 481, as the sole communication between the control chamber 24 and the annular chamber 48 while the drag valve member initially still rests on the main valve seat 46. After that, in the closing position of the third valve 479 with contact against the axial boundary wall 470 of the valve chamber 30, the valve chamber is further relieved via the throttle bore 481. A relief pressure is brought about in the valve chamber 30 that permits the drag valve member 454 to be moved by the spring 472 away from the main valve seat 46 until it contacts the valve head sealing face 51. Thus, however, the main valve 61 is also opened, so that the control chamber 30 can continue to be relieved. For execution of the main injection, the valve head 437 is thereupon moved in turn, together with the drag valve member 454, into an intermediate position in which the large communicating cross section of the main valve 61 between the outflow conduit 49 and the control chamber 24 is opened.

In a departure from the embodiment of FIG. 4, here the possibility exists of a purposeful use of throttles to determine the relief dynamics of the control chamber 24. For execution of the preinjection, the relief is determined by the throttle bore 481, and in the main injection, the relief of the control chamber 24 is determined by the larger outflow throttle 32, which is smaller than the outflow cross section of the main valve 61. The pressure in the control chamber 24 is then established together with the inlet throttle 28, for definition of the main injection with the desired gradation. The main injection is finally attained by moving the tappet 435 back into the outset position shown in FIG. 6, in which the pilot valve 58 and the main valve 61 are closed and the third valve 479 is opened. In this way, the effect of tolerance in the valve stroke can be minimized in the final stroke range of the valves. The cross sections can be adapted individually for the preinjection and the main injection.

Figure 9A:
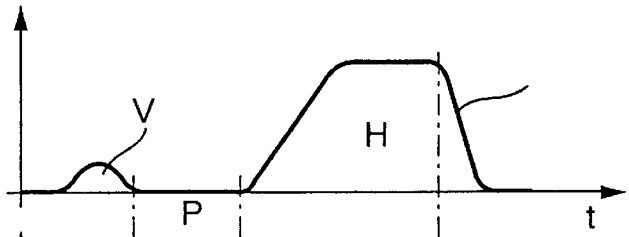
FIG. 9*a* represents the motion of the injection valve needle plotted over the stroke and the time.
Figure 9B:
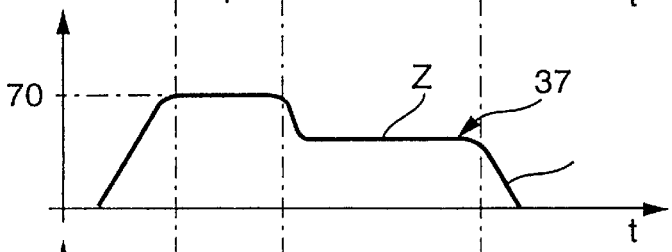
FIG. 9*b* illustrates the adjustment of the valve head for the preinjection stroke.
Figure 9C:
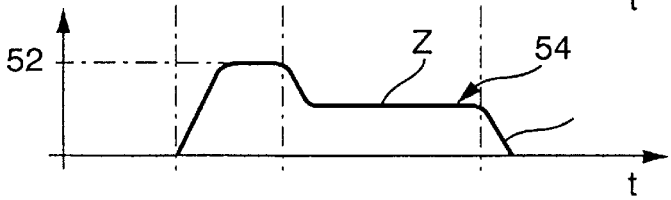
FIG. 9*c* illustrates the movement of the drag valve member from a time that the valve is closed to a time that the valve is open.

In the graphs in FIGS. 9*a*–9*c*, it is shown how the courses of motion of the injection valve needle 14, valve head 437, and drag valve member 454 are embodied. In the graph 9a at the top, the motion of the injection valve needle is plotted over the stoke and the time, with a short stroke for preinjection V, an intervening pause P in which the injection valve is closed, and an ensuing main injection H. The preinjection is tripped, as shown in the graph 9*b* below, by the adjustment of the valve head 437. Beginning at the closing position of FIG. 6, the valve head is moved through from the pilot valve seat 52 until its contacts the valve seat 470 of the third valve, which is shown by the number 470 on the ordinate of the graph. Just at that moment, the control chamber 24 is closed again, so that during the pause while the third valve 479 is also closed, the high closing pressure in the control chamber 24 is established and keeps the injection valve member 14 closed. During this period of time, however, the drag member 454 moves as shown in graph 9*c*, from the time the third valve 479 is closed until the drag member contacts the valve head 437. This position is represented in the graph by the number 52 on the abscissa. After contact is gained, the drag valve member 454 also remains in this terminal position until the end of the pause P. The control valve member is then moved back again to an intermediate position. In this process, the valve head 437 and the drag valve member move in synchronized fashion to an intermediate position Z, which leads to the complete relief of the control chamber 24. With the return of the valve head 437 and the drag valve member 454, finally, the relief of the control chamber 24 is disrupted again, and the control pressure that brings about the closure of the injection valve member builds up again.

Figure 7:
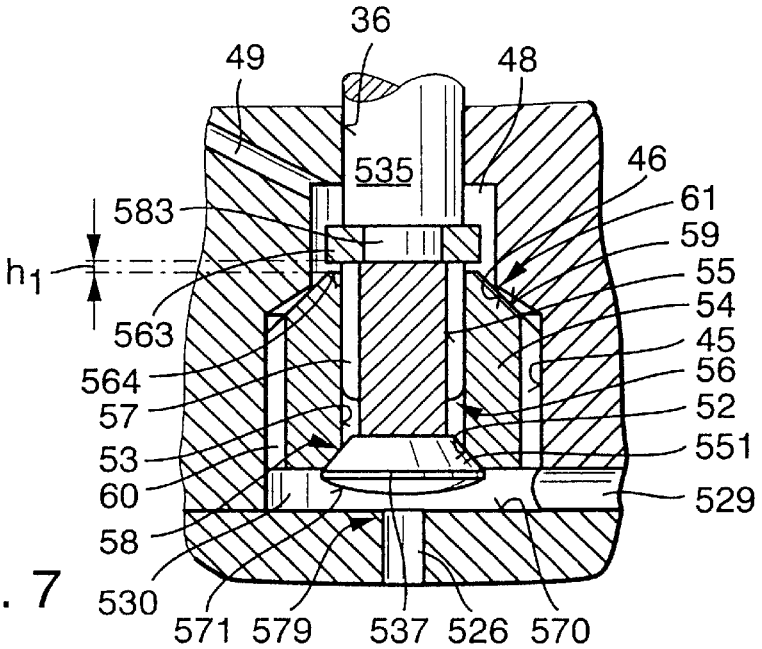
FIG. 7 shows a sixth exemplary embodiment, in which in an analogous feature to FIG. 2 the control valve controls the pressure of a control chamber with the aid of a 3/2-way valve design, where a communication from the valve chamber to the control chamber cannot be closed off, while coaxially to the control valve member, a high-pressure inflow is provided to the control chamber, which can be closed by means of an extreme position of the control valve member.

It has been shown above, in various embodiments of the control valve, that to control the pressure in the control chamber 24, a communication with the outflow conduit 49 is established, which leads to a relief of the control chamber 24. To relieve the control chamber, the control valve is merely put back in the closing position, and the constant inflow of high fuel pressure via the inflow conduit 26 is established. In principle, such valves operate as 2/2-way valves. In the present invention, such a 2/2-way valve has been modified by means of the drag valve member 54. According to FIG. 7, such a valve may, however, also be embodied as a 3/2-way valve; in a first position of the valve, communication between the high-pressure fuel reservoir and the control chamber is established, with simultaneous closure of the outflow conduit, and in a second position of the valve, the communication between the high-pressure fuel reservoir 1 and the control chamber is broken, thus establishing the communication of the control chamber with the relief conduit. FIG. 7 in this respect shows an embodiment very similar to FIG. 2, with the exception that the valve chamber 530, via the connecting conduit 529, is in constant communication with the control chamber, which is not otherwise shown here. This connecting conduit branches off from the-circumferential wall of the cylindrically embodied valve chamber 530. The inflow of high-pressure fuel is effected here at the axial end wall 570 of the valve chamber 530; this inlet 526 discharges coaxially to the axis of the valve chamber 530 or of the tappet 535. The face end 570 here forms a valve seat in the orifice region of the inlet 526, and this valve seat, in an analogous feature to FIG. 4, but with a different function here, cooperates with a face-end sealing face 571 on the valve head 537 to act as a third valve 479. Again as in the previous exemplary embodiments, the valve tappet 535 is guided in a tappet bore 436 and penetrates the annular chamber 48, which again changes over via the main valve seat 46 to the larger-diameter valve chamber 530. Cooperating with the main valve seat 46 is a valve member sealing face 59 of a drag valve member 54; embodied identically to that of FIG. 2, and this valve member sealing face is embodied conically, analogously to the conical transition between the valve chamber 530 and annular chamber 48, and is disposed on one end of the sleevelike drag valve member 54, inclined toward its outer circumference. On the opposite end of the sleevelike valve member 54, a tapered pilot valve seat 52 is again inclined toward the inner through bore 53 and cooperates with a valve head sealing face 551, which is likewise embodied in tapered fashion, on the valve head 537. In the vicinity of the annular chamber 48, the valve tappet 535 also has a driver 563, which for instance may be clipped in the form of a snap ring into an annular groove 583 of the valve tappet. If the valve head is in contact with the pilot valve seat 52 of the pilot valve 58 and if the valve member sealing face 59 is in contact with the main valve seat 46 of the main valve 61, then the driver 563 is spaced apart from a face end 564 of the drag valve member by a stroke h1. When the driver 563 contacts the face end 564, a sufficient cross section is also available to allow an outflow of fuel from the valve chamber 530, with the pilot valve open, through the flow cross section 56 formed between the valve tappet 535 and the inner through bore, to the annular chamber 48 and from there to the relief side via the outflow conduit.

Upon actuation of the valve tappet 535 by the actuator, the valve tappet can be lifted from the pilot valve seat 52 by the valve head, so that with the simultaneous inflow of fuel via the inflow conduit 536 and outflow of fuel via the flow cross section 56 to the outflow conduit 49, a medium pressure is established in the control chamber, which suffices to cause a preinjection by opening of the injection valve member 14. For the main injection, the control valve member is switched through with the valve head 537 until its contacts the sealing face 571 on the valve seat 570, that is, until the closure of the third valve 579. Thus the inflow of high-pressure fuel into the valve chamber and thus also into the control chamber is prevented, and the control chamber can be relieved completely to the outflow conduit 49. In the course of this motion, the driver 563 has also attained contact with the face end 564, and the drag valve member 54 has lifted from the main valve seat 46, so that a very large relief cross section from the control chamber 24 to the outflow conduit 49 is also achieved. To terminate the main injection, the valve tappet is thereupon moved back with the valve head 537 into the outset position shown, in which the third valve 579 is open and the pilot valve 58 and the main valve 61 are closed. The high pressure can then be built up again in the control chamber by means of the inflowing high-pressure fuel, and the injection valve member 14 can be put in the closing position. In an analogous way, the features of FIGS. 3 and 5 can also be employed in a 3/2-way control valve of this kind.

The foregoing relates to preferred exemplary embodiments of the invention, it being understood that other variants and embodiments thereof are possible within the spirit and scope of the invention, the latter being defined by the appended claims.

We claim:

1. A fuel injection system for internal combustion engines, which comprises a high-pressure fuel source (1) from which a fuel injection valve (9) is supplied with fuel, said injection valve has an injection valve member (14) for controlling an injection opening (12) and has a control chamber (24), which is defined by a movable wall (22), said movable wall is at least indirectly connected to the injection valve member (14), said control chamber has an inflow conduit (26) arriving from a high-pressure fuel source (1), and an outflow conduit (29) that leads to a relief chamber, pressure in the relief chamber is controlled by a control valve (31), which controls the inflow conduit (26, 126) or an outflow conduit (29, 49) and is actuated by a piezoelectric actuator (41), the control valve (31) has a control valve member (34) with a valve tappet (35), said valve tappet is guided in a housing and a valve head (37, 137) on an end that protrudes into a valve chamber (30), said valve head includes a valve head sealing face (51) that points toward a valve seat (52) and controls an outflow cross section of an outflow conduit (49), the valve chamber (30, 130) communicates with the control chamber (24) and is exposed to a pressure of the high-pressure fuel source (1) when the outflow cross section is closed, and by means of the control valve, two outflow cross sections of different size are opened successively.

2. The fuel injection system according to claim 1, in which the valve tappet (35) is surrounded by a sleevelike drag valve member (54), inside the valve chamber (30, 53) said sleevelike drag valve member (54) has an inner boundary face (53) along the valve tappet (35, 135) and along which an inner flow cross section (56) exists, and the drag valve member (54), on one axial end on a side toward the valve head sealing face (51), has a pilot valve seat (52), said pilot valve seat together with the valve head sealing face (51) forms a pilot valve (58), said pilot valve controls a first outflow cross section that communicates with the outflow conduit (49) via the inner flow cross section (56), and on another axial end said drag valve member (54) has a valve member sealing face (59), said valve member sealing face cooperates with a main valve seat (46) structurally connected to the housing, thereby forming a main valve (61) which controls a second outflow cross section of the outflow conduit and downstream of which the outflow conduit (49) leads onward.

3. The fuel injection system according to claim 2, in which an outer flow cross section toward the main valve seat (46) exists between the wall (45) of the valve chamber (30) and the drag valve member (54).

4. The fuel injection system according to claim 3, in which the main valve seat (46) is formed at a transition from the valve chamber (30) to an annular chamber (48) which is penetrated by the valve tappet (35) and from which the outflow conduit (49) leads onward.

5. The fuel injection system according to claim 4, in which the control valve member (34) is movable by the piezoelectric actuator (41) by a length of defined strokes and upon actuation of the control valve member (34) for a relief of the pressure in the valve chamber (30) via the first outflow cross section of the outflow conduit, in a first stroke, the valve head sealing face (51) of the pilot valve (58) is lifted from the pilot valve seat (52), and in an ensuing further stroke of the control valve member (34), the drag valve member (54) is lifted from the main valve seat (46) and the second outflow cross section of the outflow conduit (49) is opened.

6. The fuel injection system according to claim 5, in which the drag valve member (54) is lifted from the main valve seat (46) by a driver (63) disposed on the control valve member (34).

7. The fuel injection system according to claim 6, in which the driver (63) is a ring, which is inserted into an annular groove of the tappet (35) and which when the pilot valve (58) is closed has a spacing h1, defining a pilot control stroke, from the face end (64) of the drag valve member (54).

8. The fuel injection system according to claim 5, in which the drag valve member (54) is urged toward the valve head sealing face (251, 451) by a compression spring (272, 472) braced firmly on the housing, and after an opening of the pilot valve (58) and an attendant pressure reduction upstream of the pilot valve, the drag valve member is moved away from the main valve seat (46) toward the valve head sealing face (251, 451) and the latter is tracked.

9. The fuel injection system according to claim 6, in which the drag valve member (54) is spaced apart from the adjacent tappet (35) and guided by longitudinal spacing ribs (57), thereby forming the inner flow cross section.

10. The fuel injection system according to claim 6, in which the drag valve member (54), on an outer jacket face, has longitudinal spacing ribs (60) by means of which said drag valve member is guided on a cylindrical circumferential wall (45) of the valve chamber (30), forming the outer flow cross section.

11. The fuel injection system according to claim 2, in which the valve tappet (135, 335), in a region of a part leading away from the annular chamber (48) and guided in the housing, is provided with a sleeve (166, 366) in which said sleeve has an outer diameter which is greater than the diameter of the inner boundary face (53) of the drag valve member (54).

12. The fuel injection system according to claim 11, in which the sleeve (166, 366) is press-fitted onto the valve tappet (135, 335).

13. The fuel injection system according to claim 11, in which the sleeve (166) is fastened onto the valve tappet (135) between a lock washer (168), which is fixed to the valve tappet outside a guide, and a stop (167) on the valve tappet (135).

14. The fuel injection system according to claim 8, in which the drag valve member (54) is guided with a cylindrically inner boundary face (453) on the cylindrical outer jacket (455) of the tappet (435), and an annular recess (480) which is in continuous communication with the annular chamber (48) is provided in a region of coincidence of the inner boundary face with the outer jacket of the tappet (435).

15. The fuel injection system according to claim 11, in which a first sealing face (375) is provide on the face end of the sleeve (366), and an opposite side of the drag valve member (354) likewise has a second sealing face (376), the first and second sealing faces together forming a third valve (379) which opens toward the inner flow cross section and is closed when the valve tappet (335) has completed a stroke for opening the first outflow cross section of the pilot valve (58).

16. The fuel injection system according to claim 15, in which the first and second sealing faces of the third valve (479) are embodied conically.

17. The fuel injection system according to claim 1, in which the control chamber (24) communicates constantly with the high-pressure source (1) via an inlet throttle (28), and the flow cross section of the inlet throttle is smaller than the first outflow cross section (32) of the outflow conduit (29, 49).

18. The fuel injection system according to claim 17, in which the effective outflow cross section of the outflow conduit (49) is defined by an outflow throttle (32).

19. The fuel injection system according to claim 17, in which the control chamber (24) communicates with the valve chamber (30) via a connecting conduit (29) that leads coaxially away toward the axis of the valve tappet (35).

20. The fuel injection system according to claim 19, in which the outlet of the connecting conduit (29) into the valve chamber (30) from the control chamber can be closed by a face end (271, 471) of the valve head (235, 435) of the control valve (231, 431) embodied as a sealing face, and is closed, at the end of the pilot control stroke of the control valve member, after a duration of relief of the control chamber (24) that is determined by the adjusting motion of the control valve member.

21. The fuel injection system according to claim 20, in which the outflow throttle (32) is disposed in the connecting conduit (29).

22. The fuel injection system according to claim 1, in which the valve chamber (530) communicates with the high-pressure fuel reservoir (1) via a pressure conduit (526) that enters the valve chamber (530) coaxially to the axis of the valve tappet (535) and communicates with the control chamber via an unclosable connecting conduit (529), and an entrance of the pressure conduit (526) into the valve chamber is closable by a face end (571), embodied as a sealing face, of the valve head (537) of the control valve member at an end of the stroke of a control valve member serving to relieve the control chamber (530) for preinjection, in order to define an onset of the relief of the control chamber for the main injection.

* * * * *